US006049948A

United States Patent [19]

Leonardi

[11] Patent Number: 6,049,948

[45] Date of Patent: Apr. 18, 2000

[54] HANDLE FOR CARRYING A BAG

[76] Inventor: Stefano A. Leonardi, 8 Gainsborough Road, Finchley, London N12 8AG, United Kingdom

[21] Appl. No.: 09/174,354

[22] Filed: Oct. 15, 1998

[51] Int. Cl.[7] ..... A45C 13/22

[52] U.S. Cl. ..... 16/428; 16/422; 294/171

[58] Field of Search ..... 16/428, 114.1, 16/406, 411, 443, 444, 422; 294/170, 171

[56] References Cited

U.S. PATENT DOCUMENTS

| | | | |
|---|---|---|---|
| 2,314,522 | 3/1943 | Sette | 16/444 |
| 2,398,436 | 4/1946 | Mason | 294/171 |
| 2,846,714 | 8/1958 | Charlick | 294/171 |
| 3,913,172 | 10/1975 | Richards et al. | 294/171 |
| 4,049,357 | 9/1977 | Hamisch, Jr. | 16/444 |
| 4,071,063 | 1/1978 | Russell | 294/171 |
| 4,791,702 | 12/1988 | McVey | 16/428 |
| 4,932,702 | 6/1990 | Sweeny | 294/171 |
| 5,738,401 | 4/1998 | Fan | 294/171 |

FOREIGN PATENT DOCUMENTS

| | | | |
|---|---|---|---|
| 4026280 A1 | 2/1992 | Germany | 294/171 |

*Primary Examiner*—Chuck Y. Mah

[57] ABSTRACT

A new handle for carrying a bag for distributing the weight of the contents of the bag across the hand of a user. The inventive device includes a saddle member that has a top, a bottom, a pair of end edges, and a pair of side edges that extend between the end edges. A pair of sides upwardly extend from the side edges of the saddle member to form a bag receiving channel between them such that a carrying loop of a bag, or a plurality of carrying loops of one or several bags, rests on the top of the saddle member between the sides of the saddle member. A cover member covers the saddle member and is removably coupleable to the saddle member. The cover member has first and second ends, upper and lower surfaces extending between the first and second ends, and a pair of opposite sidewalls that downwardly extend from the lower surface of the cover member. A carrying strap is provided to permit hands-free carrying of the bag or bags and distribute the weight of the bag or bags across the body

14 Claims, 3 Drawing Sheets

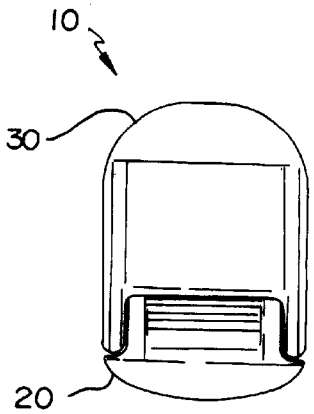
FIG. 3
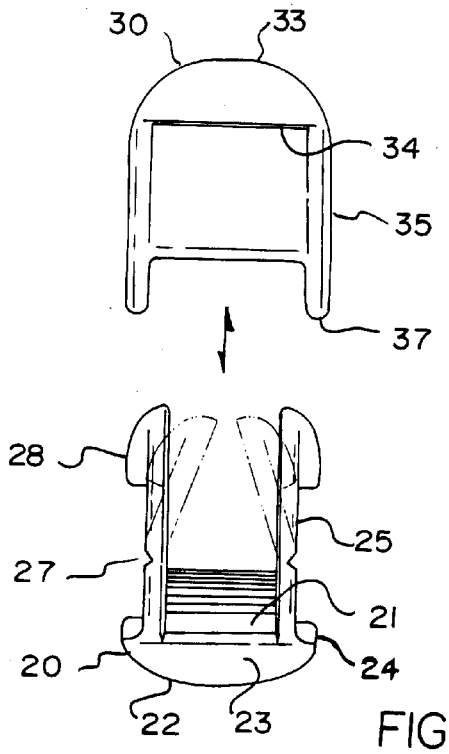
FIG. 4
FIG. 5
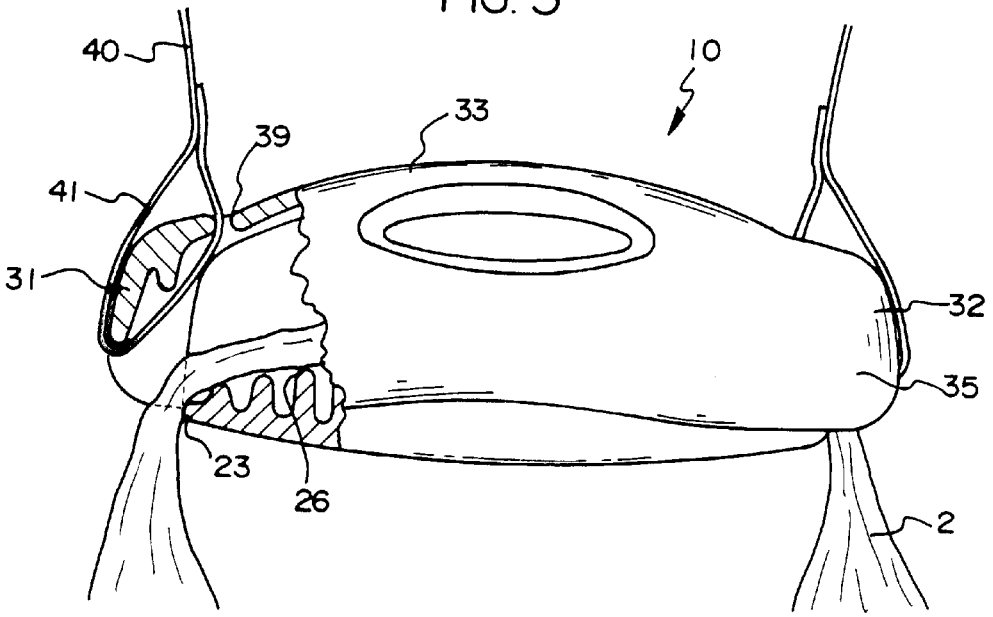

HANDLE FOR CARRYING A BAG

BACKGROUND OF THE INVENTION

1. Field of the Invention

The present invention relates to hand protecting handles and more particularly pertains to a new handle for carrying a bag for distributing the weight of the contents of the bag across the hand of a user.

2. Description of the Prior Art

The use of hand protecting handles is known in the prior art. More specifically, hand protecting handles heretofore devised and utilized are known to consist basically of familiar, expected and obvious structural configurations, notwithstanding the myriad of designs encompassed by the crowded prior art which have been developed for the fulfillment of countless objectives and requirements.

Known prior art hand protecting handles include U. S. Pat. No. 5,029,926; U.S. Pat. No. 4,890,355; U.S. Pat. No. 5,118,201; U.S. Pat. No. 3,083,366; U.S. Pat. No. 645,670; and U.S. Pat. No. Des. 337,053.

While these devices fulfill their respective, particular objectives and requirements, the aforementioned patents do not disclose a new handle for carrying a bag. The inventive device includes a saddle member that has a top, a bottom, a pair of end edges, and a pair of side edges that extend between the end edges. A pair of sides upwardly extend from the side edges of the saddle member to form a bag receiving channel between them such that a carrying loop of a bag rests on the top of the saddle member between the sides of the saddle member. A cover member covers the saddle member and is removably coupleable to the saddle member. The cover member has first and second ends, upper and lower surfaces extending between the first and second ends, and a pair of opposite sidewalls that downwardly extend from the lower surface of the cover member.

In these respects, the handle for carrying a bag according to the present invention substantially departs from the conventional concepts and designs of the prior art, and in so doing provides an apparatus primarily developed for the purpose of distributing the weight of the contents of the bag across the hand of a user.

SUMMARY OF THE INVENTION

In view of the foregoing disadvantages inherent in the known types of hand protecting handles now present in the prior art, the present invention provides a new handle for carrying a bag construction wherein the same can be utilized for distributing the weight of the contents of the bag across the hand of a user.

The general purpose of the present invention, which will be described subsequently in greater detail, is to provide a new handle for carrying a bag apparatus and method which has many of the advantages of the hand protecting handles mentioned heretofore and many novel features that result in a new handle for carrying a bag which is not anticipated, rendered obvious, suggested, or even implied by any of the prior art hand protecting handles, either alone or in any combination thereof.

To attain this, the present invention generally comprises a saddle member that has a top, a bottom, a pair of end edges, and a pair of side edges that extend between the end edges. A pair of sides upwardly extend from the side edges of the saddle member to form a bag receiving channel between them such that the carrying loops of a bag or bags rest on the top of the saddle member between the sides of the saddle member. A cover member covers the saddle member and is removably coupleable to the saddle member. The cover member has first and second ends, upper and lower surfaces extending between the first and second ends, and a pair of opposite sidewalls that downwardly extend from the lower surface of the cover member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new handle for carrying a bag apparatus and method which has many of the advantages of the hand protecting handles mentioned heretofore and many novel features that result in a new handle for carrying a bag which is not anticipated, rendered obvious, suggested, or even implied by any of the prior art hand protecting handles, either alone or in any combination thereof.

It is another object of the present invention to provide a new handle for carrying a bag which may be easily and efficiently manufactured and marketed.

It is a further object of the present invention to provide a new handle for carrying a bag which is of a durable and reliable construction.

An even further object of the present invention is to provide a new handle for carrying a bag which is susceptible of a low cost of manufacture with regard to both materials and labor, and which accordingly is then susceptible of low prices of sale to the consuming public, thereby making such handle for carrying a bag economically available to the buying public.

Still yet another object of the present invention is to provide a new handle for carrying a bag which provides in the apparatuses and methods of the prior art some of the advantages thereof, while simultaneously overcoming some of the disadvantages normally associated therewith.

Still another object of the present invention is to provide a new handle for carrying a bag for distributing the weight of the contents of the bag across the hand of a user.

Yet another object of the present invention is to provide a new handle for carrying a bag which includes a saddle member that has a top, a bottom, a pair of end edges, and a pair of side edges that extend between the end edges. A pair of sides upwardly extend from the side edges of the saddle member to form a bag receiving channel between them such that the carrying loops of a bag or bags rest on the top of the saddle member between the sides of the saddle member. A cover member covers the saddle member and is removably coupleable to the saddle member. The cover member has first and second ends, upper and lower surfaces extending between the first and second ends, and a pair of opposite sidewalls that downwardly extend from the lower surface of the cover member.

Still yet another object of the present invention is to provide a new handle for carrying a bag that keeps the handle loops of several bags together to keep the bags from rolling around and opening. For example, the bags may be placed on the floor with less chance of having the contents spill out of them.

Even still another object of the present invention is to provide a new handle for carrying a bag that prevents bag loops from digging into the palms and fingers of a user's hand.

Even still yet another object of the present invention is to provide a new handle for carrying a bag that includes a carrying strap that permits hands-free carrying of the bag or bags and distributes the weight of the bag or bags across the body.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side view of the present invention.

FIG. 4 is an exploded view of the present invention.

FIG. 5 is a breakaway view of the present invention.

DESCRIPTION OF THE PREFERRED EMBODIMENT

Figure 1:
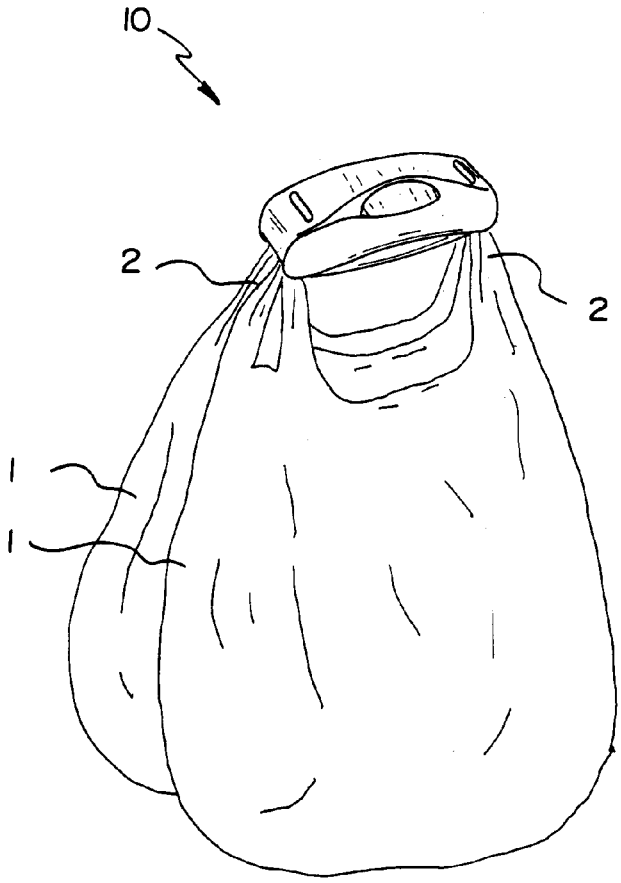
FIG. 1 is a perspective view of a new handle for carrying a bag according to the present invention.
Figure 2:
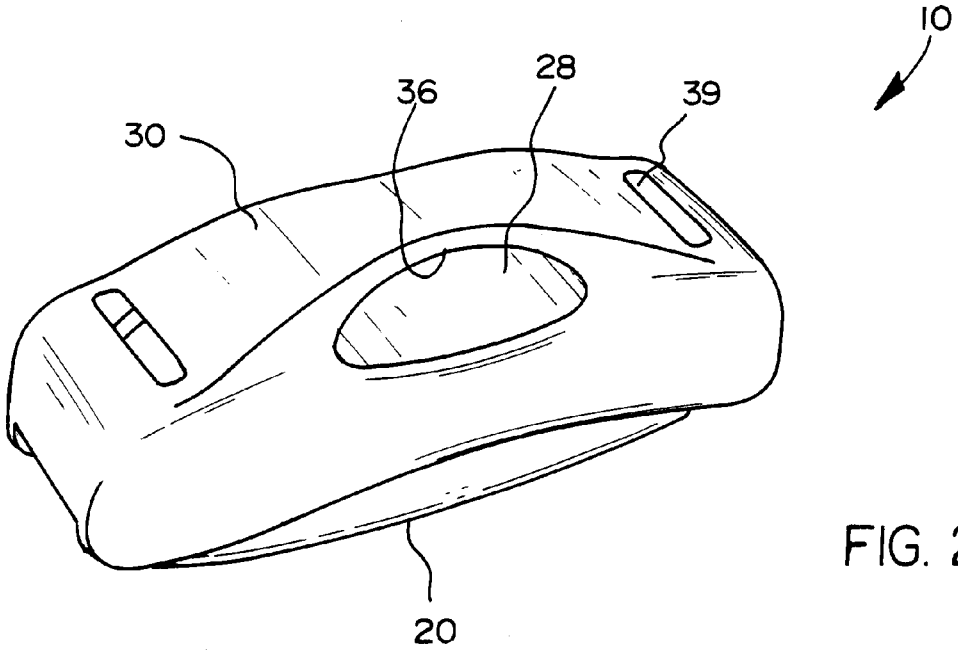
FIG. 2 is a perspective view of the present invention.
Figure 6:
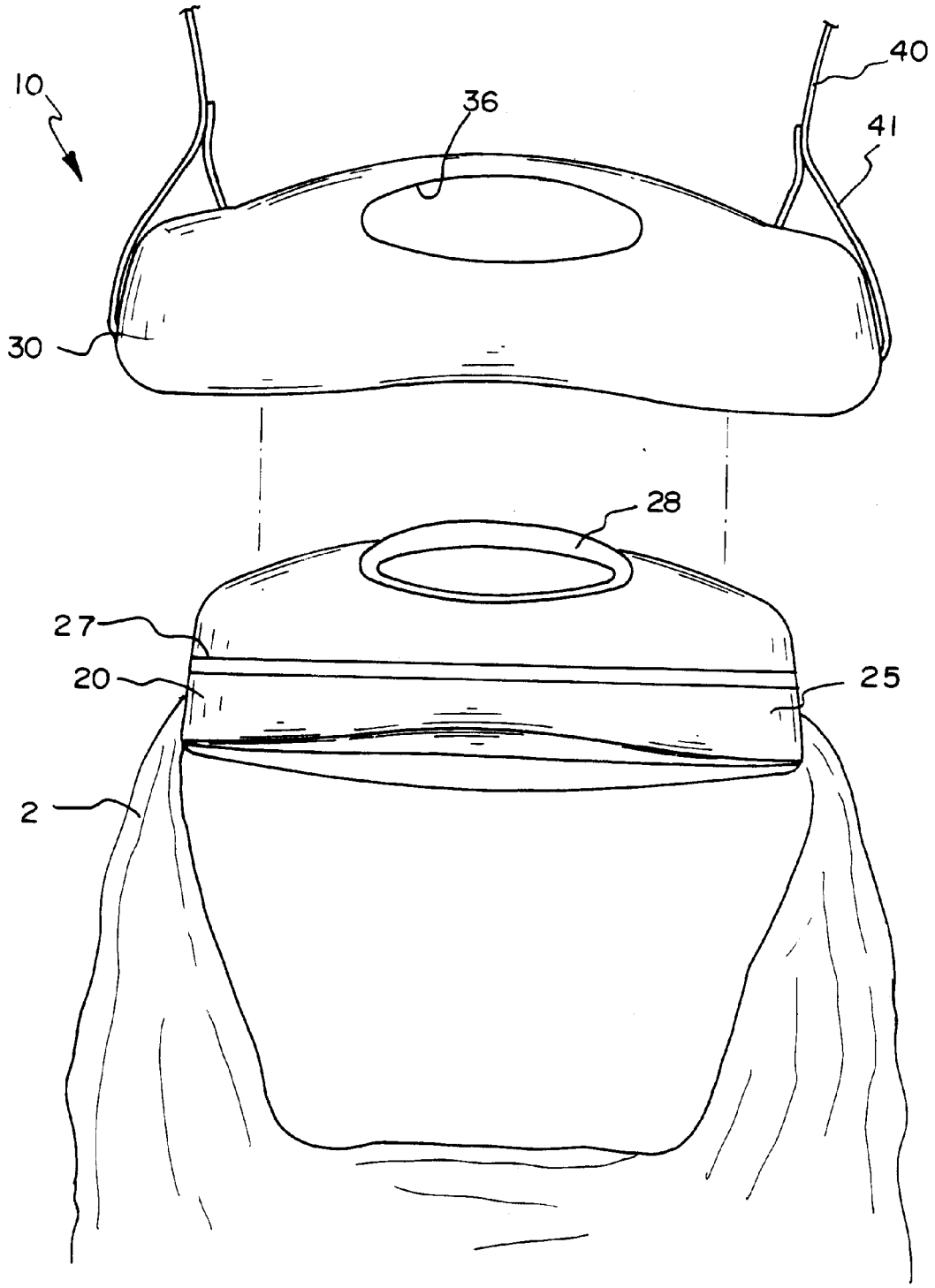
FIG. 6 is an exploded view of the present invention.

With reference now to the drawings, and in particular to FIGS. 1 through 6 thereof, a new handle for carrying a bag embodying the principles and concepts of the present invention and generally designated by the reference numeral 10 will be described.

As best illustrated in FIGS. 1 through 6, the handle 10 comprises a saddle member 20 that has a top 21, a bottom 22, a pair of end edges 23, and a pair of side edges 24 that extend between the end edges 23. A pair of sides 25 upwardly extend from the bottom 22 of said saddle member 20 adjacent the side edges 24 to form a bag receiving channel between them such that a carrying loop 2 of a bag 1, or the carrying loops of one or several bags, rests on the top 21 of the saddle member 20 between the sides 25 of the saddle member 20. A cover member 30 covers the saddle member 20 and is removably coupleable to the saddle member 20. The cover member 30 has first and second ends 31,32, upper and lower surfaces 33,34 extending between the first and second ends 31,32, and a pair of opposite sidewalls 35 that downwardly extend from the lower surface 34 of the cover member 30.

In an exemplary embodiment, the distance between the end edges 23 of the saddle member 20 is less than about five inches. Also exemplary, the distance between the sides 25 of the saddle member 20 is less than about one and one-half inches.

Preferably, each of the sidewalls 35 of the cover member 30 has a clip receiving aperture 36 extending through it. The lower surface 34 of the cover member 30 defines a portion of each of the clip receiving apertures 36. An upper portion of each of the sides 25 has a clip flange 28 extending from it. The clip flanges 28 are adapted to extend into the clip receiving apertures 36 of the sidewalls 35 of the cover member 30 to releasably couple the saddle member 20 to the cover member 30.

More preferably, each of the sides 25 of the saddle member 20 has a resiliently flexible living hinge 27 that extends along a length of each of the sides 25 substantially parallel the top 21 of the saddle member 20 and above the teeth 26 of the saddle member 20. The living hinge 27 permits pivoting of an upper portion of each of the sides 25 of the saddle member 20 SO that the clips may be more easily slid along the sidewalls 35 of the cover member 30 and inserted in the clip receiving apertures 36 of the cover member 30.

Also more preferably, each of the sidewalls 35 of the cover member 30 has a lower edge 37 and a guide groove (not shown) that extends between the clip receiving aperture and the lower edge 37 of each of the sidewalls 35. The guide grooves (not shown) slidably receive and guide the clip flanges 28 of the sides 25 of the saddle member 20 towards the clip receiving apertures 36 of the sidewalls 35 of the cover member 30.

Preferably, the top 21 of the saddle member 20 has a plurality of teeth 26 that extend from it into the bag receiving channel. The teeth 26 are arranged in a row that extends between the end edges 23 of the saddle member 20. A carrying loop 2 of a bag 1, or the carrying loops of one or several bags, is positionable across the teeth 26.

More preferably, each of the teeth 26 has a width that extends between the sides 25 of the saddle member 20. In such an embodiment, the teeth 26 are generally parallel to each other. The teeth 26 are positioned generally perpendicular to the top 21 of the saddle member 20.

Ideally, each of the teeth 26 has a height. As illustrated in FIGS. 4 and 5, the height of the teeth 26 that are positioned towards the end edges 23 of the saddle member 20 is less than the height of the teeth 26 that are positioned towards a midpoint between the side edges 24 of the saddle member 20.

Preferably, as best illustrated in FIG. 5, the cover member 30 has a pair of spaced apart strap receiving apertures 39 that extend through it for receiving a carrying strap 40. The strap receiving apertures 39 are positioned towards and substantially parallel to the first and second ends 31,32 of the cover member 30.

Ideally, the handle 10 also includes a carrying strap 40 with a pair of end loops 41. Each of the end loops 41 is adapted to extend through one of the strap receiving apertures 39 and around one of the ends 31,32 of the cover member 30. Most ideally, the carrying strap 40 is adjustable. The carrying strap 40 permits hands-free carrying of the bag 1 or bags 1 and distributes the weight of the bag 1 or bags 1 across the body.

In use, the carrying loops 2 of one or several bags 1 are placed in the bag receiving channel of the saddle member 20. The cover member 30 is placed over the saddle member 20 and the clip flanges 28 of the saddle member 20 are slid along the guide grooves (not shown) of the cover member 30 until they snap into place in the clip receiving apertures 36 of the cover member 30. The user then grasps the handle 10 to carry the bags. The carrying strap 40 may be placed over the shoulder of the user for easier carrying. To release the carrying loops 2 of the bags 1, the clip flanges 28 of the saddle member 20 are squeezed together to release them from the clip receiving apertures 36 of the cover member 30. The cover member 30 and the saddle member 20 are pulled apart and the loops of the bags are removed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A handle for carrying a bag having at least one carrying loop, said handle comprising:

a saddle member having a top, a bottom, a pair of end edges, and a pair of side edges extending between said end edges;

said saddle member having a pair of sides upwardly extending from said bottom of said saddle member adjacent said side edges of said saddle member;

wherein said sides of said saddle member form a bag receiving channel therebetween;

a cover member for covering said saddle member, said cover member having first and second ends, upper and lower surfaces extending between said first and second ends, and a pair of opposite sidewalls downwardly extending from said lower surface of said cover member, said cover member being removably coupleable to said saddle member; and each of said sidewalls of said cover member has a clip receiving aperture extending therethrough, said lower surface of said cover member defining a portion of each of said clip receiving apertures, said upper portion of each of said sides having a clip flange being extended therefrom, said clip flanges extending into said clip receiving apertures of said sidewalls of said cover member for releasably coupling said saddle member to said cover member.

2. The handle of claim 1, wherein each of said sides of said saddle member have a resiliently flexible living hinge extending along a length thereof substantially parallel said top of said saddle member and above a plurality of teeth of said saddle member, said living hinge permitting pivoting of an upper portion of each of said sides of said saddle member.

3. The handle of claim 1, wherein each of said sidewalls of said cover member has a lower edge and a guide groove extending between said clip receiving aperture of said sidewall and said lower edge of said sidewall, said guide grooves being for slidably receiving and guiding said clip flanges of said sides of said saddle member towards said clip receiving apertures of said sidewalls of said cover member.

4. The handle of claim 1, wherein said top of said saddle member has a plurality of teeth extending therefrom into said bag receiving channel, said teeth being arranged in a row extending between said end edges of said saddle member, wherein a carrying loop of a bag is positionable across said teeth.

5. The handle of claim 4, wherein each of said teeth has a width extending between said sides of said saddle member, said teeth being generally parallel each other, said teeth being positioned generally perpendicular to said top of said saddle member.

6. The handle of claim 5, wherein each of said teeth has a height, said height of said teeth positioned towards said end edges of said saddle member being less than said height of said teeth positioned towards a midpoint between said side edges of said saddle member.

7. The handle of claim 1, wherein said cover member has a pair of spaced apart strap receiving apertures being extended therethrough, said strap receiving apertures being positioned towards said first and second ends of said cover member.

8. The handle of claim 7, further comprising a carrying strap having a pair of end loops, each of said end loops being extended through one of said strap receiving apertures and around one of said ends of said cover member.

9. A handle for carrying a bag having at least one carrying loop, said handle comprising:

a saddle member having a top, a bottom, a pair of end edges, and a pair of side edges extending between said end edges;

said saddle member having a pair of sides upwardly extending from said bottom of said saddle member adjacent said side edges of said saddle member;

wherein said sides of said saddle member form a bag receiving channel therebetween;

said top of said saddle member having a plurality of teeth extending therefrom into said bag receiving channel, said teeth being arranged in a row extending between said end edges of said saddle member;

each of said teeth having a width extending between said sides of said saddle member, said teeth being generally parallel each other, said teeth being positioned generally perpendicular to said top of said saddle member, wherein a carrying loop of a bag is positionable across said teeth;

wherein each of said teeth has a height, said height of said teeth positioned towards said end edges of said saddle member being less than said height of said teeth positioned towards a midpoint between said side edges of said saddle member;

a cover member for covering said saddle member, said cover member having first and second ends, upper and lower surfaces extending between said first and second ends, and a pair of opposite sidewalls downwardly extending from said lower surface of said cover member, said cover member being removably coupleable to said saddle member;

each of said sidewalls of said cover member having a clip receiving aperture extending therethrough, said lower surface of said cover member defining a portion of each of said clip receiving apertures;

each of said sides of said saddle member having a resiliently flexible living hinge extending along a length thereof substantially parallel said top of said saddle member and above said teeth of said saddle member, said living hinge permitting pivoting of an upper portion of each of said sides of said saddle member;

said upper portion of each of said sides having a clip flange being extended therefrom, said clip flanges extending into said clip receiving apertures of said sidewalls of said cover member for releasably coupling said saddle member to said cover member;

each of said sidewalls of said cover member having a lower edge and a guide groove extending between said clip receiving aperture in said sidewall and lower edge of said sidewall, said guide grooves being for slidably receiving and guiding said clip flanges of said sides of said saddle member towards said clip receiving apertures of said sidewalls of said cover member;

a pair of spaced apart strap receiving apertures being extended through said cover member, said strap receiving apertures being positioned towards said first and second ends of said cover member; and a carrying strap having a pair of end loops, each of said end loops being extended through one of said strap receiving apertures and around one of said ends of said cover member.

10. A handle for carrying a bag having at least one carrying loop, said handle comprising:

a saddle member having a top, a bottom, a pair of end edges, and a pair of side edges extending between said end edges;

said saddle member having a pair of sides upwardly extending from said bottom of said saddle member adjacent said side edges of said saddle member;

wherein said sides of said saddle member form a bag receiving channel therebetween;

a cover member for covering said saddle member, said cover member having first and second ends, upper and lower surfaces extending between said first and second ends, and a pair of opposite sidewalls downwardly extending from said lower surface of said cover member, said cover member being removably coupleable to said saddle member; and wherein said cover member has a pair of spaced apart strap receiving apertures being extended therethrough, said strap receiving apertures being positioned towards said first and second ends of said cover member.

11. The handle of claim 10, wherein said top of said saddle member has a plurality of teeth extending therefrom into said bag receiving channel, said teeth being arranged in a row extending between said end edges of said saddle member, wherein a carrying loop of a bag is positionable across said teeth.

12. The handle of claim 11, wherein each of said teeth has a width extending between said sides of said saddle member, said teeth being generally parallel each other, said teeth being positioned generally perpendicular to said top of said saddle member.

13. The handle of claim 12, wherein each of said teeth has a height, said height of said teeth positioned towards said end edges of said saddle member being less than said height of said teeth positioned towards a midpoint between said side edges of said saddle member.

14. The handle of claim 10, further comprising a carrying strap having a pair of end loops, each of said end loops being extended through one of said strap receiving apertures and around one of said ends of said cover member.

* * * * *